US008920131B2

(12) United States Patent
Aspen

(10) Patent No.: US 8,920,131 B2
(45) Date of Patent: Dec. 30, 2014

(54) PUMP CONTROL AND METHOD

(75) Inventor: Randal S. Aspen, Oswego, IL (US)

(73) Assignee: A.Y. McDonald Mfg. Co., Duguque, IA (US)

( * ) Notice: Subject to any disclaimer, the term of this patent is extended or adjusted under 35 U.S.C. 154(b) by 414 days.

(21) Appl. No.: 12/966,454

(22) Filed: Dec. 13, 2010

(65) Prior Publication Data

US 2012/0148419 A1 Jun. 14, 2012

(51) Int. Cl.

| | |
|---|---|
| ***F04D 15/02*** | (2006.01) |
| ***F04B 49/02*** | (2006.01) |
| ***F04B 49/06*** | (2006.01) |
| ***F04D 15/00*** | (2006.01) |

(52) U.S. Cl.

CPC ..... *F04B 49/065* (2013.01); *F04D 15/0218* (2013.01); *F04B 2205/01* (2013.01); *F04B 2205/09* (2013.01); *F04D 15/0011* (2013.01); *F04D 15/0005* (2013.01)

USPC ..... 417/43; 417/12; 417/20; 417/44.2

(58) Field of Classification Search

CPC ..... F04D 15/0227; F04B 2205/02; F04B 2205/09

USPC ..... 417/12, 20, 33, 38, 43, 44.1, 44.2, 44.4, 417/44.3

See application file for complete search history.

(56) References Cited

U.S. PATENT DOCUMENTS

| | | | | |
|---|---|---|---|---|
| 3,936,231 | A * | 2/1976 | Douglas | 417/12 |
| 4,664,528 | A * | 5/1987 | Rodgers et al. | 366/142 |
| 5,738,495 | A * | 4/1998 | Carmignani et al. | 417/44.1 |
| 5,819,848 | A * | 10/1998 | Rasmuson et al. | 166/250.15 |
| 6,099,264 | A * | 8/2000 | Du | 417/300 |
| 6,461,121 | B1 * | 10/2002 | Lelong | 417/423.1 |
| 7,901,190 | B2 * | 3/2011 | Gray | 417/22 |

FOREIGN PATENT DOCUMENTS

| | | | |
|---|---|---|---|
| EP | 1074745 | A1 * | 2/2001 |
| WO | WO 9836339 | A1 * | 8/1998 |

OTHER PUBLICATIONS

Isco, Pump and power controller, 2002.*
Kelco F-40 Data sheet, 2009.*
Kelco F-40 Installation manual, 2009.*
Grundfos MQ Brochure entitled "Domestic water supply is getting more compact . . .".
Depend on Davey Water Products Brochure entitled "HM Series Water Pressure Systems Pressure Switch Torrium."
Kelco Brochure entitled "C25 Series Inline Flow Switches".

(Continued)

*Primary Examiner* — Devon Kramer
*Assistant Examiner* — Nathan Zollinger
(74) *Attorney, Agent, or Firm* — Wood, Phillips, Katz Clark & Mortimer

(57) ABSTRACT

A pump control (20) and method are provided for controlling a pump (16) for a pressurized liquid supply system (10). The pump control (20) includes a controller (38) configured to provide at least two selectable modes of pump operation as follows:

a flow start mode wherein the controller (38) starts the pump (16) in response to a desired start flow rate of the liquid in the system (10) and stops the pump (16) in response to a desired stopping low flow rate of the liquid in the system; and a pressure start mode wherein the controller (38) starts the pump (16) in response to a desired start pressure of the liquid in the system (10) and stops the pump (16) in response to the desired stopping low flow rate.

14 Claims, 2 Drawing Sheets

(56) References Cited

OTHER PUBLICATIONS

Walrus Brochure entitled "TQ Series Electronic Control Pump ISO 9001".

Lancaster Pumps Brochure entitled "Mascontrol Domestic Pump Controller".

Simer Brochure entitled "Booster Pump—Ace in the Hole Series".

* cited by examiner

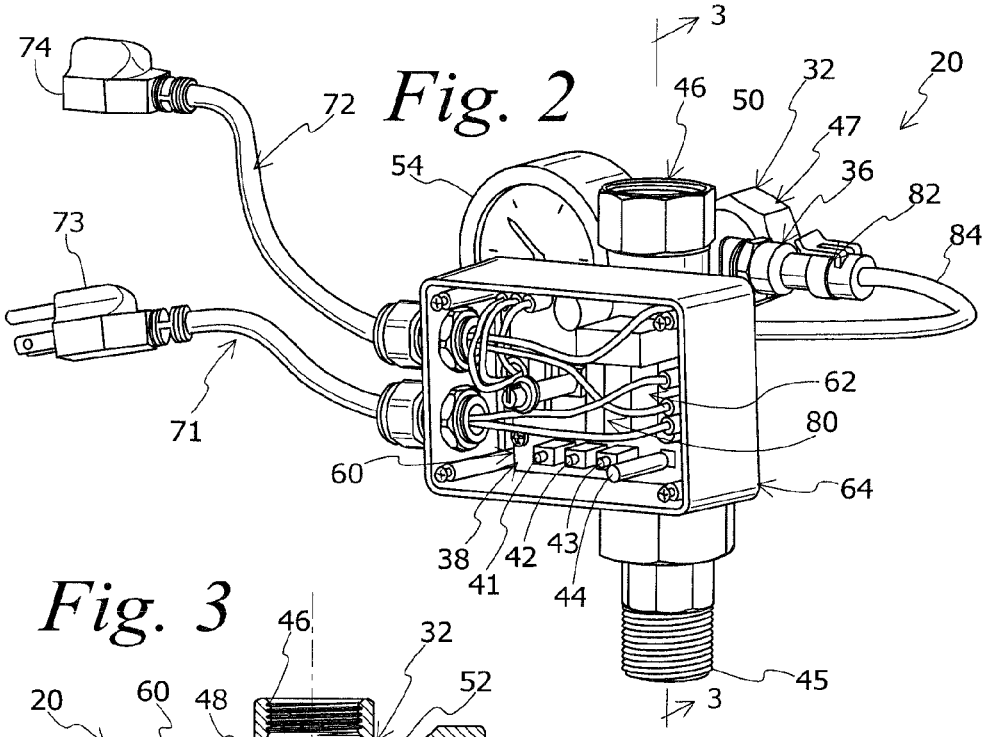
Fig. 2
Fig. 3
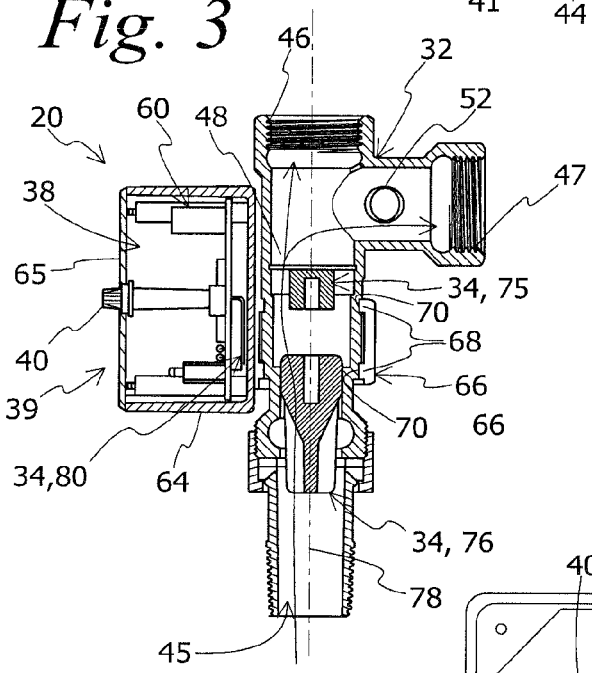
Fig. 4
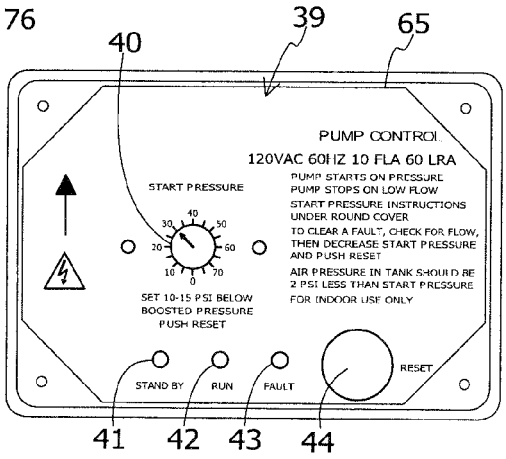

PUMP CONTROL AND METHOD

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to pump control systems and methods, and in more particular applications, booster pump control systems and methods for residential use.

BACKGROUND OF THE INVENTION

Residential booster pump systems are known that provide the water supply system in a residence with additional/supplemental pressure to the incoming "city pressure" provided from a public water supply system. Typically, the controls for such booster pumps utilize an on/off pressure type switch wherein the booster pump starts when the water pressure in the home drops to a preselected start pressure and the booster pump runs until a preselected stop pressure is reached, with both the start and stop pressures being greater than the "city pressure" at the inlet side of the booster pump. Typically, these preset pressures are 20-40 psi, 30-50 psi and 40-60 psi, with the lower pressure being the start pressure and the upper pressure being the stop pressure. These systems require a relatively large diaphragm pressure tank in order to prevent short cycling of the booster pump.

It is also known to control a residential booster pump by starting the booster pump when the home pressure drops to a preselected start pressure and stopping the pump when the flow rate through the booster pump reaches a preselected "low flow rate". These systems are also capable of starting at a preselected flow rate if that is encountered before the preselected start pressure. One advantage of such a control over the on/off pressure type switch is that a large diaphragm tank is not required. However, a smaller diaphragm tank (for example a two-gallon diaphragm tank) should be installed with such systems to account for small leaks and thermal expansion from any water heaters in the system.

SUMMARY OF THE INVENTION

In accordance with one feature of the invention, a pump control is provided for controlling a pump for a pressurized liquid supply system. The pump control includes a controller configured to provide at least two selectable modes of pump operation as follows: a pressure start mode wherein the controller starts the pump in response to a desired start pressure of the liquid in the system and stops the pump in response to a desired stopping low flow rate of the liquid in the liquid supply system; and a flow start mode wherein the controller starts the pump in response to a desired start flow rate of the liquid in the system and stops the pump in response to the desired stopping low flow rate.

According to one feature, the desired start pressure is greater than a nominal supply pressure to an inlet side of the pump.

According to another feature, the desired start pressure is less than a nominal supply pressure to an inlet side of the pump.

In one feature, the controller is configured to start a delay timer when the desired stopping low flow rate is detected and to reset the delay timer if a flow rate greater than the desired stopping low flow rate is detected before the delay timer reaches a preselected period of time.

As one feature, the controller is configured to start a delay timer when the desired start flow rate is detected and to reset the delay timer if a flow rate less than the desired start flow rate is detected before the delay timer reaches a preselected period of time.

According to one feature, the pump control further includes a flow sensor in communication with the controller to signal the desired start flow rate and the desired stopping low flow rate.

In one feature, the pump control further includes a pressure sensor in communication with the controller to signal the desired start pressure.

As one feature, the pump control further includes a releasable electric power connection to the pump controlled by the controller.

In one feature, the pump control further includes a control body having a liquid inlet port, two liquid outlet ports, and a liquid flow path connecting the inlet port to the outlet ports, with the control body carrying the controller.

According to one feature, the pump control further includes a flow sensor mounted in the liquid flow path and in communication with the controller to signal the desired start flow rate and the desired stopping low flow rate.

As one feature, the pump control further includes a pressure sensor mounted on the control body in fluid communication with the liquid flow path and in communication with the controller to signal the desired start pressure.

In one feature, the controller is configured to provide a third selectable mode of pump operation wherein the controller starts the pump in response to a pressure of the liquid in the system that is less than a nominal supply pressure to an inlet side of the pump.

In accordance with one feature of the invention, a booster pump control is provided for controlling the booster pump of a liquid supply system having a nominal supply pressure to an inlet side of the pump. The pump control includes a flow sensor to sense a flow rate of the liquid in the system, a pressure sensor to sense a pressure of the liquid in the system, a controller in communication with the flow sensor and the pressure sensor to receive respective signals therefrom indicating the flow rate and the pressure, respectively, of the liquid in the system. The controller is configured to provide at least two selectable modes of operation as follows: a pressure start mode of operation wherein the controller starts the pump when the signal from the pressure sensor indicates a preselected start pressure and stops the pump when the signal from the flow sensor indicates a preselected stopping low flow rate, the preselected start pressure being higher than the nominal supply pressure; and a flow start mode wherein the controller starts the pump when the signal from the flow sensor indicates a preselected high flow rate and stops the pump when the signal from the flow sensor indicates a preselected stopping low flow rate.

According to one feature, the controller is configured to supply a third selectable mode of operation wherein the controller starts the pump when the signal from the pressure sensor indicates a preselected pressure that is lower than the nominal supply pressure.

In accordance with one feature of the invention, a method is provided for controlling a pump for a pressurized liquid supply system. The method includes the steps of: sensing a pressure of the liquid in the liquid supply system; sensing a flow rate of the liquid in the liquid supply system; starting the pump in two distinct modes of operation, with one of the modes of operation starting the pump based on input from the sensing a pressure step and the other mode of operation starting the pump based on input from the sensing a flow rate step; and stopping the pump in both distinct modes of operation based on input from the sensing a flow rate step.

According to one feature, the step of sensing a pressure comprises sensing a pressure that is greater than a nominal supply pressure to an inlet side of the pump.

According to another feature, the step of sensing a pressure comprises sensing a pressure that is less than a nominal supply pressure to an inlet side of the pump.

In one feature, the step of stopping the pump further includes starting a delay timer when a preselected stopping low flow rate of the liquid is sensed and resetting the delay timer if a flow rate greater than the preselected stopping low flow rate is sensed before the delay timer reaches a preselected period of time.

As one feature, the step of starting the pump based on input from the sensing a flow rate step comprises starting a delay timer when a preselected start flow rate of the liquid is sensed and resetting the delay timer if a flow rate less than the preselected start flow rate is sensed before the delay timer reaches a preselected period of time.

According to one feature, the step of starting the pump further includes starting the pump in a third distinct mode of operation, with the one of the modes of operation including starting the pump based on input from the sensing a pressure step indicating a boost start pressure has been sensed, the third distinct mode of operation including starting the pump based on input from the sensing a pressure step indicating an economy start pressure has been sensed, the boost start pressure being greater than a nominal supply pressure to an inlet side of the pump, and the economy start pressure being less than the nominal supply pressure.

Other objects, features, and advantages of the invention will become apparent from a review of the entire specification, including the appended claims and drawings.

BRIEF DESCRIPTION OF THE DRAWINGS

FIG. 2 is a perspective view of the pump control of FIG. 1, with a cover of the pump control removed;

FIG. 3 is a section view taken along line 3-3 in FIG. 2;

FIG. 4 is a view of the user interface and cover of the pump control of FIGS. 2 and 3.

DETAILED DESCRIPTION OF THE PREFERRED EMBODIMENT

Figure 1:
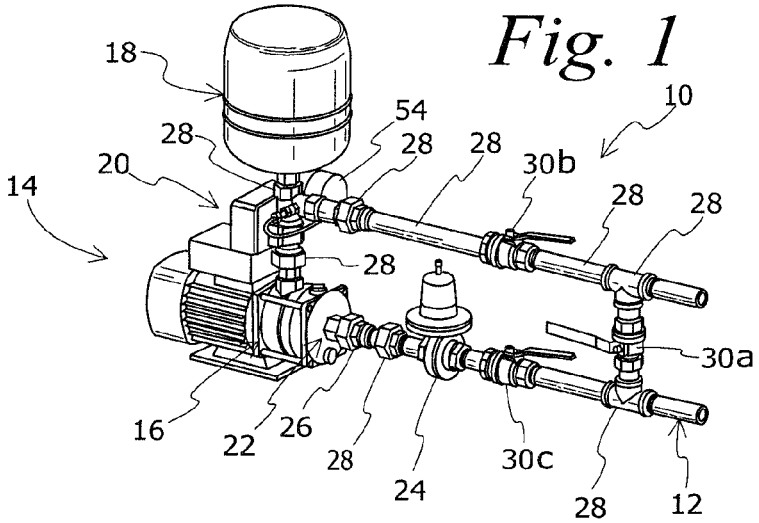
FIG. 1 is a perspective view of a pressurized residential water supply system including a booster pump system and pump control embodying the present invention.

FIG. 1 illustrates a pressurized residential water supply system 10 that receives water from a public water supply system via a supply line 12. The system 10 includes a booster pump system 14 having an electric motor driven booster pump 16, a pressure tank 18, and a pump control 20 embodying the present invention. The public water system supplies water to an inlet side 22 of the booster pump 16 at a nominal supply pressure $P_N$ that may optionally be regulated by a pressure regulating or reducing valve 24, and the booster pump system 14 provides additional/supplemental pressure so that the residential water supply system 10 is maintained at or near a "boost" pressure $P_B$ that is greater than the nominal supply pressure $P_N$. In this regard, the booster pump system 14 preferably includes a check valve 26 located on the inlet side 22 of the booster pump 16 in order to maintain the desired "boost" (additional/supplemental) pressure $P_B$ in the residential water supply system 10 and the booster pump system 14. Additionally, the booster pump system 14 preferably utilizes standard water supply conduits and fittings 28 and appropriately located valves 30 to allow for portions of the booster pump system 14 to be isolated for maintenance and repair, such as, for example, via a bypass valve 30*a* that is normally closed but that can be opened in sequence with the closing of shutoff valves 30*b* and 30*c* to allow maintenance and/or repair of the booster pump system 14. It should be understood that the nominal supply pressure $P_N$ will typically be a fixed input to the system 14 that is determined at installation based upon the "city pressure" that is typically provided by the associated public water system supply.

FIGS. 2-4 illustrate an embodiment of the control 20 for the booster pump 16, which is preferably a single speed pump. The pump control 20 includes a control body 32, a flow meter or sensor 34, a pressure transducer 36, and a controller, shown generally at 38, that receives signals from both the flow sensor 34 and pressure transducer 36. The controller 38 is configured to provide at least two selectable modes of operation, with one of the modes being a flow start mode and another of the modes being a pressure start mode.

In the flow start mode, the controller 38 starts the pump 16 in response to a desired start flow rate $F_H$ of the water through the system and stops the pump 16 in response to a desired stopping low flow rate $F_L$ of the water in the system 10, with both the start flow rate $F_H$ and the stopping low flow rate $F_L$ being signalled or indicated to the controller by the flow sensor 34. In one preferred embodiment, the desired stopping low flow rate is ½ gpm or less, which would indicate a low demand in the typical residential water supply system 10, the start flow rate $F_H$ is 1 gpm or higher, which would indicate a higher demand in the typical residential water supply system 10. One advantage of the flow start mode is that it resists cycling of the pump 16 when the pressure from the public water supply system varies or when there are slight leaks in the system 10.

In the pressure start mode, the controller 38 starts the pump 16 in response to a desired start pressure $P_S$ of the water in the system 10 and stops the pump in response to the desired stopping low flow rate $F_L$, with the pressure transducer 36 indicating or signalling the desired start pressure to the controller 38, and the stopping low flow rate $F_L$ being signalled or indicated to the controller by the flow sensor 34.

In one preferred mode of the pump control 20, the desired start pressure $P_S$ is set greater than the nominal supply pressure $P_N$ at the inlet side 22 of the pump 16. In the embodiment, it is preferred that the start pressure $P_S$ be 10 to 15 psi below the desired static boost pressure $P_B$.

In another preferred mode of the pump control 20, the desired start pressure $P_S$ is set less than the nominal supply pressure $P_N$ to the inlet side 22 of the pump 16. For example, if the nominal supply pressure $P_N$ is 35 psi, the desired start pressure $P_S$ can be set to 30 psi so that the pump 16 will only be started when the pressure in the system 14 drops below 30 psi. This particular configuration is advantageous to saving energy because the pump 16 will typically only start under conditions of peak demand for the water supply system 10, such as, for example, multiple showers, multiple bathtubs, or an irrigation system running. In other low demand situations, the nominal supply pressure $P_N$ provided by the public water supply system can be used, such as, for example, flushing toilets, running a single sink, or other low pressure drop applications.

In a highly preferred embodiment, the controller 38 provides three selectable modes of pump operation with one of the modes being the previously described flow start mode and the other two of the modes being pressure start modes as previously described, with one of the pressure start modes having a desired start pressure $P_S$ that is greater than the nominal supply pressure $P_N$ to the inlet side 22 of the pump 16 and the other of the pressure start modes having a desired start pressure $P_{S2}$ that is less than the nominal supply pressure $P_N$ to the inlet side 22 of the pump 16.

Preferably, in each of the above-described pressure start modes of operation, the controller is configured to start the pump 16 solely in response to the desired start pressure $P_S$ and, in the flow start mode, to start the pump 12 only in response to the desired start flow rate $F_H$. It is also preferred that in each of the modes of operation, the controller 38 be configured to stop the pump 16 solely in response to the desired stopping low flow rate $F_L$.

It is also preferred that the controller 38 be configured to provide a delay timer to delay the starting of the pump 16 for a preselected period of time $t_1$ after receiving the first indication or signal for the start flow rate $F_H$ and to reset the delay timer without starting the pump 16 if a flow rate less than the desired start flow rate is detected before the delay timer reaches the preselected period of time $t_1$. This feature helps to prevent false starts of the pump 16 due to transient fluctuations in the flow and/or pressure in the system 14. Further, it is preferred that the controller 38 be configured to provide a delay timer that will delay the stopping of the pump 16 for a preselected period of time $t_2$ after the desired stopping low flow rate $F_L$ is detected and to reset the delay timer without stopping the pump 16 if a flow rate greater than the desired flow rate $F_L$ is detected before the delay timer reaches the preselected period of time b. Again, as with the delay timer feature for pump start, this feature helps to reduce repetitive cycling of the pump 16 due to transient fluctuations in the flow or pressure of the water in the system 14. In one preferred embodiment, $t_1$=3 seconds and $t_2$=7 seconds.

Furthermore, it is preferred that the controller 38 be configured to average the signal or indication from the pressure transducer 36, such as by utilizing an averaging formula wherein the system averages the signal from four points in time each separated by a time interval $t_i$ and then taking an average of the four points and using that average as the actual indication of the pressure in the system 14. This preferred feature is particularly desirable when the pressure transducer 36 utilizes a DC power supply and the signal from the pressure transducer 36 is influenced by electronic noise from the DC power supply. Thus, for one working example, if a 60 hertz system is passed through the DC power supply, the controller 38 would be configured to record the signal at a set of four points separated by a time interval $t_i$ of 4.166 milliseconds and then take an average (1/60÷4).

FIG. 4 shows a representation of a cover (not shown in FIG. 1) and user interface 39 for the controller 39, with the user interface 39 including a start pressure control dial 40, a standby indicator light 41 that is preferably green, a run indicator light 42 that is preferably blue, a fault indicator light 43 that is preferably red, and a system reset switch or button 44. When the pump 16 is running, the blue run indicator light 42 is on and the other indicator lights are off, and when the pump 16 is not running, the green standby light 41 is on and the other indicator lights are off. To indicate that the delay timer is running, the controller 38 is preferably configured to flash the blue run indicator light 42 on and off during the stop delay time period $t_1$ and to flash the green standby indicator light 41 on and off during the start delay time period $t_2$. It is also preferred that the controller 38 be configured to provide "dry-run" protection where the control 20 stops the pump 16 and illuminates the red fault indicator light 43 if water is not available to the system 14 or if pressure is not achieved. In this regard, the control 20 will automatically re-start the pump and attempt to clear the fault every 15 minutes for 1 hour, flashing the red fault indicator light 43 one time for every 15 minute time period that has passed. If the fault is not cleared after 1 hour, the control 20 will shut down and the red fault indicator light 43 will be left on.

One advantage of the pressure start mode is that the controller 38 can be easily and finely adjusted to start the pump at 10-15 psi less than the static boosted pressure $P_B$, which allows a narrow differential pressure range, thereby running the booster pump 16 whenever there is a demand. In this regard, the rotary dial 40 is preferably configured on the controller 38 to select starting pressures ranging from 5 psi to 75 psi, with 5 psi increments. Setting the dial 40 to 0 psi initiates the flow control mode.

Preferably, the control body 32 has an inlet port 45, and one or more outlet ports 46 and 47, with a flow path, shown generally by arrows 48 and defined by cylindrical bores, connecting the inlet port 45 to the outlet ports 46 and 47. It is also preferred that the ports 45, 46, and 47 be configured to accept conventional fittings so as to allow easy incorporation of the pump control 20 into the system 14, such as, for example, by allowing the pressure tank 18 to be installed on either of the outlet ports 46 and 47 with the other of the ports 46 and 47 serving as the discharge port to the system 10. It is also preferred that a pair of oppositely spaced ports 50 (shown in FIG. 2) and 52 (shown in FIG. 3) be provided in the control body 32, with one of the ports 50 and 52 accepting the pressure transducer 36 and the other of the ports 50 and 52 accepting a pressure gauge 54 that is readable by a user of the system, with pressure gauge 54 and transducer 36 being interchangeable from one port 50 to the other port 52 as dictated by each installation. While a preferred form of the control body 32 is shown, it should be understood that other forms of the control body may be utilized if dictated by a particular application.

In the illustrated embodiment, the controller 38 is provided in the form of a circuit board 60 that includes a programmable microcontroller, shown generally at 62, and is housed in a control box 64 that is closed by a cover 65 that helps define the user interface 39. It should be appreciated that many suitable circuit board constructions and programmable microcontrollers 5 are known and can be utilized in the pump control 20 and the details of such constructions are not the focus of the application and will not be discussed herein. The control box 64 is preferably mounted to the control body 32 via a ring clamp 66 having a pair of radially inwardly directed annular ribs 68 that are received in corresponding annular slots 70 on the control body 32 so as to allow the control box 64 to be swivelled about the control body 32 so that, for each particular installation, the position of the control box 64 can be optimized for easy viewing of the interface 39 by a user. Power is supplied to the system 14 via a power cord 71 connected to the controller 38 and extending from the control box 64, and power is selectively provided from the pump control 20 to the pump 16 via a power supply cord 72 connected to the controller 38 and extending from the control box 64. Preferably, the power cords 71 and 72 are each provided with a suitable electrical connector, such as the illustrated three prong 120V male and female connectors 73 and 74 shown in FIG. 2, that allow for the pump control to be easily connected and disconnected from both the pump 16 and an electric power supply. It should be understood that while preferred forms of the controller 38, power cords 71, 72, and control box 34 are shown, many suitable types/constructions of these components are known and may be utilized in the pump control 20 if desired.

The illustrated flow sensor 34 is known and includes a pair of opposed magnets, with one of the magnets being a stationary magnet 75 that is fixedly suspended in the flow path 48 and the other of the magnets being a magnetic piston 76 mounted for translational movement along a longitudinal axis 78 of the flow path 48 in response to the water flow through the flow path 48, with increasing flow rates moving the piston 76 further along the axis 78 against the opposing magnetic force of the stationary magnet 75. A reed switch 80 is provided in the control box 64 adjacent the control body 32 and the magnets 75, 76 and is actuated between on and off positions by the magnetic flux from the magnetic piston 76 as the piston 76 translates along the axis 78, with the on position signalling $F_H$ and the off position signalling $F_L$. The control 20 can also be configured to provide other systems or devices an indication that flow is passing through the system 10. For example, the control 20 could provide such a signal to a fire sprinkler warning system or indicator or to other flow related devices. It should be understood that while a preferred flow senor 34 is shown, many other suitable types of flow sensors are know and may be utilized in the pump control 10 if desired.

The pressure transducer 36 is preferably an automotive grade transducer and includes an electrical connector 82 that allows for the transducer to be easily connected and disconnected to a signal line 84 connected to the controller 38 and extending from the control box 64. Importantly, because the pressure transducer 36 is external from the controller 38, the pressure transducer 36 can be installed in other locations remote from the pump control 20 and the control body 32 if desired for a particular application. While a preferred form of the pressure transducer 36 is described herein, it should be understood that many suitable types/constructions are known for pressure transducers and may be used in the pump control 10 if desired.

It should be appreciated that the magnetic flow sensor 34, the electrical power connectors 73, 74, the electrical connector 82, and the clamp 66 combine to allow the controller 38 and control box 64 to be removed and/or replaced without shutting water off to the system 14.

In one highly preferred embodiment, the system 14 provides at least three distinct modes or methods, as follows:

Mode 1—Pressure Start—The controller 38 starts the booster pump 16 at a start pressure $P_S$ that will be preferably 10-15 psi below the static boosted pressure $P_B$, and the controller 38 stops the booster pump 16 at the preset stopping low flow rate $F_L$ of ½ gpm.

Mode 2—Flow Start—The controller 38 starts the booster pump 16 at a start flow rate $F_H$ of 1 gpm and stops the booster pump at a preset stop flow rate $F_L$=0.5 gpm.

Mode 3—Pressure Start-Energy Saver—The start pressure $P_S$ in the controller 38 is adjusted below incoming city pressure $P_N$ and only starts the pump 16 at peak demands, such as multiple showers, bath tubs, or irrigation system running. This allows the city pressure $P_N$ to be used for flushing toilets, running a single sink, or other low pressure drop applications.

Figure 5:
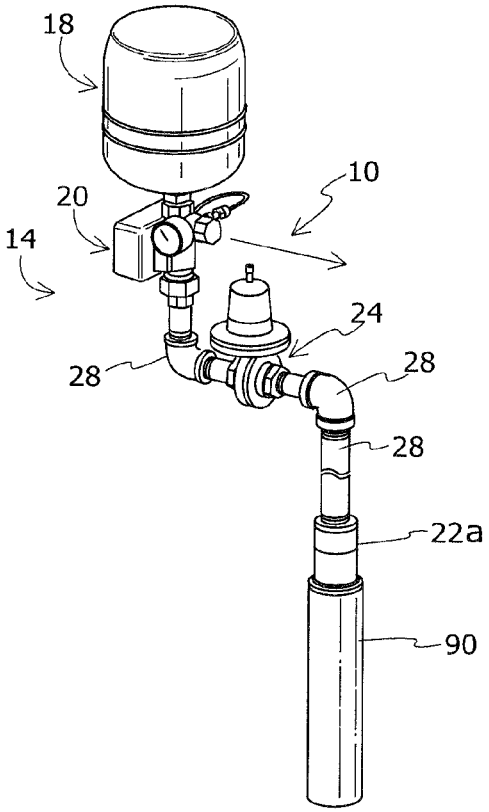
FIGS. 5 and 6 illustrate the pump control in other types of water or liquid supply systems.
Figure 6:
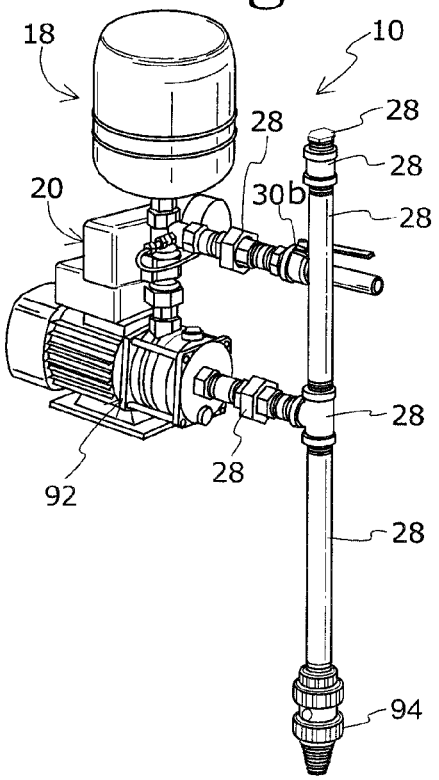

While control 20 has been described herein in connection with a booster pump 16, it can also be used with a submersible pump 90 as shown in FIG. 5, or suction lift pump 92 having a foot valve 94 as shown in FIG. 6. It should be noted that the flow start mode will not work in suction lift applications.

The invention claimed is:

1. A pump control for controlling a pump for a pressurized liquid supply system, the pump control comprising:

a controller configured to provide at least two user selectable modes of pump operation as follows:

a user interface operably connected to the controller to allow a user to select between the at least two user selectable modes of pump operation;

a flow start mode wherein the controller starts the pump in response to a desired start flow rate of the liquid in the system and stops the pump in response to a desired stopping low flow rate of the liquid in the system; and a pressure start mode wherein the controller starts the pump solely in response to a desired start pressure of the liquid in the system and stops the pump in response to the desired stopping low flow rate.

2. The pump control of claim 1 wherein the desired start pressure is greater than a nominal supply pressure to an inlet side of the pump.

3. The pump control of claim 1 wherein the desired start pressure is less than a nominal supply pressure to an inlet side of the pump.

4. The pump control of claim 1 wherein the controller is configured to start a delay timer when the desired stopping low flow rate is detected and to reset the delay timer if a flow rate greater than the desired stopping low flow rate is detected before the delay timer reaches a preselected period of time.

5. A pump control for controlling a pump for a pressurized liquid supply system, the pump control comprising:

a controller configured to provide at least two selectable modes of pump operation as follows:

a flow start mode wherein the controller starts the pump in response to a desired start flow rate of the liquid in the system and stops the pump in response to a desired stopping low flow rate of the liquid in the system; and a pressure start mode wherein the controller starts the pump in response to a desired start pressure of the liquid in the system and stops the pump in response to the desired stopping low flow rate;

wherein the controller is configured to start a delay timer when the desired start flow rate is detected and to reset the delay timer if a flow rate less than the desired start flow rate is detected before the delay timer reaches a preselected period of time.

6. The pump control of claim 1 further comprising a flow sensor in communication with the controller to signal the desired start flow rate and the desired stopping low flow rate.

7. The pump control of claim 1 further comprising a pressure sensor in communication with the controller to signal the desired start pressure.

8. The pump control of claim 1 further comprising a releasable electric power connection to extend from the controller to the pump controlled by the controller to supply power to the pump.

9. A pump control for controlling a pump for a pressurized liquid supply system, the pump control comprising:

a controller configured to provide at least two selectable modes of pump operation as follows:

a flow start mode wherein the controller starts the pump in response to a desired start flow rate of the liquid in the system and stops the pump in response to a desired stopping low flow rate of the liquid in the system; and a pressure start mode wherein the controller starts the pump solely in response to a desired start pressure of the liquid in the system and stops the pump in response to the desired stopping low flow rate;

further comprising a control body having a liquid inlet port, two liquid outlet ports, and a liquid flow path connecting the inlet port to the outlet ports, the control body carrying the controller, the control body not being formed by any part of a pump housing.

10. The pump control of claim 9 further comprising a flow sensor mounted in the liquid flow path and in communication with the controller to signal the desired start flow rate and the desired stopping low flow rate.

11. The pump control of claim 9 further comprising a pressure sensor mounted on the control body in fluid communication with the liquid flow path and in communication with the controller to signal the desired start pressure.

12. The pump control of claim 1 wherein the controller is configured to provide a third selectable mode of pump operation wherein the controller starts the pump in response to a pressure of the liquid in the system that is less than a nominal supply pressure to an inlet side of the pump.

13. A booster pump control for controlling the booster pump of a liquid supply system having a nominal supply pressure to an inlet side of the pump, the pump control comprising:

a flow sensor to sense a flow rate of the liquid in the system;

a pressure sensor to sense a pressure of the liquid in the system;

a controller in communication with the flow sensor and the pressure sensor to receive respective signals therefrom indicating the flow rate and the pressure, respectively, of the liquid in the system, the controller configured to provide at least two user selectable modes of operation as follows:

a pressure start mode of operation wherein the controller starts the pump solely in response to a signal from the pressure sensor indicating a preselected start pressure and stops the pump when the signal from the flow sensor indicates a preselected stopping low flow rate, the preselected start pressure being higher than the nominal supply pressure;

a flow start mode wherein the controller starts the pump when the signal from the flow sensor indicates a preselected high flow rate and stops the pump when the signal from the flow sensor indicates a preselected stopping low flow rate; and a user interface operably connected to the controller to allow a user to select between the at least two user selectable modes of pump operation.

14. The booster pump control of claim 13 wherein the controller is configured to supply a third selectable mode of operation wherein the controller starts the pump solely in response to a signal from the pressure sensor indicating a preselected pressure that is lower than the nominal supply pressure.

* * * * *